United States Patent [19]

Fassbinder

[11] Patent Number: 5,052,918

[45] Date of Patent: Oct. 1, 1991

[54] METHOD AND A REGENERATOR FOR HEATING GASES

[75] Inventor: Hans-Georg Fassbinder, Sulzbach-Rosenberg, Fed. Rep. of Germany

[73] Assignee: Klockner CRA Patent GmbH, Duisburg, Fed. Rep. of Germany

[21] Appl. No.: 444,231

[22] Filed: Dec. 1, 1989

[30] Foreign Application Priority Data

Dec. 10, 1988 [DE] Fed. Rep. of Germany ..... 3841708

[51] Int. Cl.[5] ..... F23D 3/40

[52] U.S. Cl. ..... 431/7; 431/170; 165/4; 165/9.3

[58] Field of Search ..... 431/7, 170, 215; 165/4, 165/9.3, 9.4

[56] References Cited

U.S. PATENT DOCUMENTS 2,272,108 2/1942 Bradley ..... 165/4

4,604,051 8/1986 Davies ..... 432/181

*Primary Examiner*—Carroll B. Dority

*Attorney, Agent, or Firm*—Armstrong, Nikaido, Marmelstein, Kubovcik & Murray

[57] ABSTRACT

The present invention relates to a method and a regenerator for heating gases, by alternatingly first heating heat carriers, preferably a bed of heat carrier bodies, and thereafter utilizing this energy stored by the heat carriers to heat cold gases. The essential feature of the invention is that a loose bed of the heat carriers is located between two coaxial and equidistant grates of the regenerator, and that the hot gas flows through this bed from the inside to the outside during the heating up phase of the regenerator and the cold gas flows through it in the reverse direction, from the outside to the inside, during the gas heating phase. This method and the regenerator provide advantages for gas heating due to lower thermal losses of the regenerator itself, and increased heat transmission is obtained due to large heat exchange surfaces of the heat carriers in a bed with a relatively low pressure loss for the gas flowing through.

13 Claims, 1 Drawing Sheet

METHOD AND A REGENERATOR FOR HEATING GASES

Figure 1:
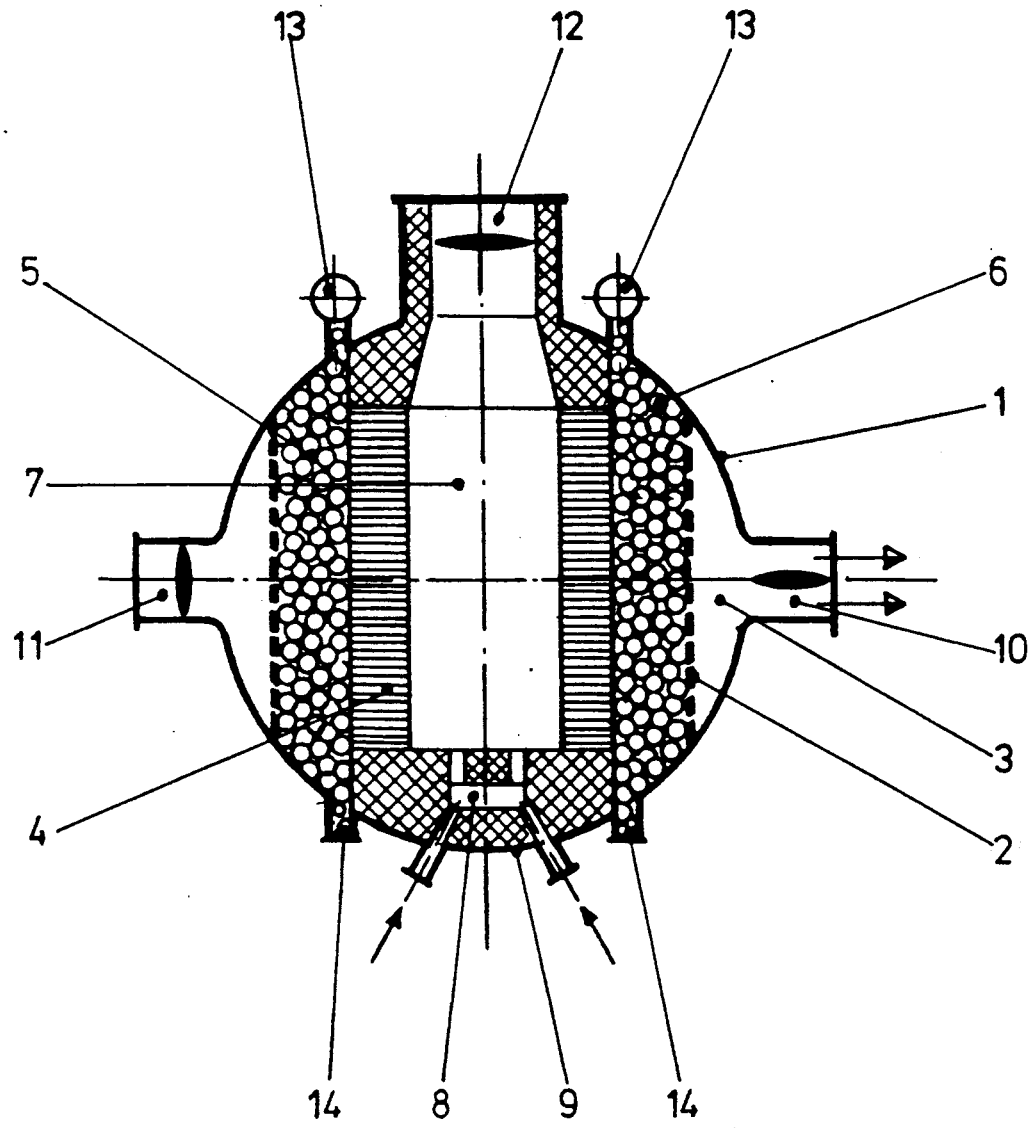

The present invention relates to a method and a regenerator for heating gases by alternatingly first heating up heat carriers and thereafter utilizing this energy stored by the heat carriers to heat cold gases.

The principle of regenerative gas heating is known and is used in various areas of industry. For example, the hot blast for blast furnace operation is heated by this method in blast heaters (Cowpers) to a temperature of about 1200° C. The thermal energy from the combustion of furnace gas in the combustion chamber of the blast heater is transferred to the checker work of its refractory stove fillings and, after the end of the heating up phase, cold air is blown through the heated checkers and heated by the stored heat. The checker chambers for Siemens-Martin and glass trough furnaces operate by the same method.

For the continuous heating of cold gases, at least two regenerators are necessary according to the described mode of operation, one being heated and thus storing heat while the other releases the stored heat to the cold gases blown in, thereby heating them.

When designing and building regenerators one must always make a compromise between thermal requirements and building possibilities. Thus, for heating the blast in blast furnace operation the known blast heaters with a cylindrical shape and a diameter to height ratio of about 1:5 have come into use. The design of the checker walling, that is flowed through in the heating up phase from the top to the bottom and in the gas heating phase in the opposite direction, from the bottom to the top, must take account of not only the requirements of the heat transmission between the gas and the checker walling but also the preconditions for a tolerable pressure loss of the gases when flowing through the refractory fillings. While a large surface and narrow ducts are favorable for the heat transmission, the free cross section of flow can only be restricted up to a certain limit in order to maintain an acceptable pressure loss for the gas stream. The larger free cross section of the flow ducts impairs the heat transmission, thereby increasing the excessively high temperature of the combustion gases for heating up the heat-retaining walling with respect to the obtainable blast temperature. To reach the stated furnace blast temperature of 1200° C., one requires a flame temperature in the heating up phase of about 1500° C. This flame temperature cannot be reached with the furnace gas released by the blast furnace, so that an additional burning of rich gas, e.g. natural gas, is necessary and customary.

A known way of improving the thermal efficiency of the regenerators is to clearly increase the surface of the heat-retaining bodies. There are a number of proposals on how to do this. In a particularly effective way of approaching this goal, one replaces the checker walling by a suitable bed of material having an approximately uniform grain size. One can use, for example, pellets made of refractory materials.

A regenerator with an appropriate bed of heat-retaining bodies of oval or spherical shape in a diameter range of 5 to 15 mm makes it possible to increase the effective surface for heat exchange to such an extent, compared to a checker walling, that the temperature difference between the flame or the waste gas in the heating phase and the heated gas in the gas heating phase is small, being around 10° C.

However, the usual checkers of a blast heater for blast furnace operation, for example, cannot be replaced by a bed of the stated kind since this would result in an unacceptably high pressure loss when gas flows through, due to the great height of the bed.

Known proposals for avoiding the pressure loss by considerably increasing the diameter of the blast heater and obtaining a reverse diameter to height ratio compared to the conventional construction, for example, show considerably improved heat transmission with about the same pressure loss, but involve other drawbacks. The dome above the heat carrier bed raises building problems and proves to be disadvantageous during operation of such a blast heater. Firstly, the considerable dome volume leads to a relatively high loss of gas at the switch from the heating up phase to the gas heating phase and, secondly, the large surface of the dome clearly increases the thermal losses in this hot area of the blast heater. Thirdly, it is barely possible to produce a bed of even thickness that has a large cross section while being relatively thin, and in particular to maintain it during operation.

The invention is thus based on the problem of providing a method for heating gases and a corresponding regenerator which allows for gas heating without the disadvantages of the known systems, and in particular has the advantages of lower thermal losses with increased heat transmission due to large heat exchange surfaces in an even bed of heat carriers with a relatively low pressure loss for the gases flowing through.

This problem is solved according to the invention by locating a loose bed of the heat carriers between at least two coaxial and equidistant grates and having the hot gas flow through this bed from the inside to the outside during the heating up phase of the regenerator, and the cold gas flow through it in the reverse direction, from the outside to the inside, during the gas heating phase.

The inventive method has a number of advantages compared to the known processes in regenerative hot gas production, both from the thermal point of view and in terms of the construction of such systems. In particular, the thermal losses are reduced by the clearly smaller stream of heat toward the outer wall of the regenerator, since the high temperature areas are located in its center and the outer wall comes in contact only with cold gases. This results in the improved thermal efficiency, on the one hand, and in clear advantages for the construction of the regenerator, on the other hand, due to savings in the steel required and the refractory lining because of smaller dimensions and lower temperature stress compared to the known systems having the same heating capacity, i.e. gas throughput and gas temperature.

Surprisingly enough, the inventive method yields very even hot gas temperatures, so that corresponding temperature control is unnecessary in many cases of application. For example, in hot blast generation for blast furnace operation a scattering of the waste gas temperature between 20° C. and 40° C. can be expected with a blast temperature of 1200° C. and a switchover time of the gas heating phase after 30 min.

According to the invention, a relatively small temperature difference is necessary between the heat carriers and the gases. This applies both to the heating up of the heat carriers themselves and to the final temperature of the gases to be heated up, for example air. For heating up the heat carriers one thus requires only combustion gases with a flame temperature slightly higher than the heating up temperature of the cold gases. For example, furnace gas from the blast furnace or only slightly enriched furnace gas can be used when heating the blast for blast furnace operation.

When the inventive method was used to preheat the blast to 1150° C., the heat carriers were heated up in the regenerator with furnace gas having a thermal value of about 750 kcal/Nm3 and a resulting flame temperature of about 1200° C. Virtually the same heating up temperatures can be achieved with the stated operating values when heating other gases, for example nitrogen, argon, oxygen-enriched air, oxygen and combustion gases.

The inventive regenerator, in which alternatingly heat carriers are first heated up and this energy stored by the heat carriers is thereafter utilized to heat cold gases, is characterized by the fact that it has centrally about the axis of symmetry a hot gas collecting chamber formed by a first, inner grate, and at least one further, outer grate disposed equidistantly from the inner grate, a gas collecting chamber being located between this outer grate and the outer wall of the regenerator, and the gases flowing radially through the bed of the heat carriers disposed between the grates.

This inventive regenerator has some clear advantages over the known comparable apparatus. The heat carriers, similarly to the fillings of a blast heater, consist of loose bodies with an approximately even grain. Due to the bed of these heat carriers between the equidistant grates, the layer thickness is even in the direction of flow of the gases. Furthermore, in the inventive regenerator the heat carriers cannot move under the influence of the flow, so there is no danger of an outbreak of gas, due for example to the fluidizing point being exceeded locally.

In the inventive regenerator the free volume between the heat carriers and also in the hot gas chamber and gas collecting chamber is relatively low, so there are only small gas losses at the switch from the heating up phase to the gas heating phase.

The heat carriers can be replaced in the inventive regenerator during operation. Appropriate connection pieces or flanges on the top and bottom of the bed make it possible to refill the heat carriers on one side and remove them on the opposite side.

The regenerator often has only a uniform bed of one sort of heat carrier which is disposed between an inner and an outer grate. However, it is also within the scope of the invention to use more than two coaxial grates, thereby producing a plurality of coaxial annular chambers. Between two adjacent grates one preferably uses the same heat carriers. However, it is possible to use different beds of heat carriers in each annular chamber. For example, high temperature resistant ceramic balls, e.g. of corundum, can be used between two grates on the hot inner side of the regenerator, while less expensive heat carriers of e.g. mullite and/or chamotte are used on the colder side toward the outside. The total bed can be divided into two and more layers not only from a financial point of view, but also for operational, in particular thermal reasons. Both the material and the size and shape of the heat carriers can be varied according to the invention.

The grates of the inventive regenerator can be made of the same, but preferably of different, materials. For example, the inner grate on the hot side can be made of refractory material, such as refractory bricks with appropriate gas ducts, and the outer grate on the cold side of metal, such as steel, nonscaling steel or cast iron. If other grates are used between the inner and the outer grate, the material must also be selected in accordance with the temperature stress. Ceramic or metal materials are mainly used.

An essential feature of the invention is to build up the bed of the heat carriers in an even thickness and have the gases flow through it in the radial direction. This feature also holds if the heat carrier bed is divided into several layers.

Suitable materials for the heat carriers have proven to be ceramic materials of different qualities, for example based on corundum, mullite, chamotte, magnesia, chromium oxide, zirconia, silicon carbide and any mixtures thereof, as well as metal materials. Of course, the heat carrier materials must be selected in accordance with their temperature stress. The shape of the heat carriers for the invention can basically be chosen at will, but some shapes may be preferable in accordance with their economical and expedient production, e.g. pelletizing and briquetting, in particular for ceramic materials. Geometrically, these are essentially oval or spherical shapes. However, one can also use beds of any split and fractured structures.

The inventive method and the inventive regenerator are particularly suitable for use in the smelt reduction of iron ore, electric smelting and blast furnaces.

The invention shall now be explained in more detail with reference to an exemplary embodiment and a FIGURE.

FIG. 1 shows schematically the cross section of an inventive regenerator.

This regenerator comprises an outer steel shell 1 of approximately spherical shape. Although the outer shape of the regenerator is unimportant and can thus be chosen at will, certain shapes such as upright cylinders, spheres or double truncated cones one above the other with and without a cylindrical piece therebetween have proven useful in practice, mainly for reasons of production engineering.

Steel shell 1 contains cylindrical outer grate 2 with circular and/or slot-shaped openings Between this grate 2 and outer steel shell 1 there is annular gas collecting chamber 3 for the cold gas.

Inner grate 4 is built up of refractory bricks with appropriate gas ducts The coaxial arrangement of the two grates 2 and 4 ensures for space 5 therebetween the same distance between these two grates along the entire periphery. This space 5 of circular cross section takes up heat carriers 6, for example pellets of ceramic material.

In the center of the regenerator there is hot gas chamber 7 of circular cross section. At the lower end of this hot gas chamber 7 the hot waste gases generated in furnace 8 flow in during the heating up phase of the regenerator. Furnace 8 is accessible via vessel lid 9.

The hot combustion gases flow from hot gas chamber 7 through grate 4 and through the bed of heat carriers 6 into chamber 5, further through grate 2 into gas collecting chamber 3. On their way through the bed of heat carriers 6 the gases have cooled off and reach gas collecting chamber 3 at approximately normal temperature. They leave the gas collecting chamber, and thus the regenerator, through connection piece 10.

During the gas heating phase, compressed gas flows through connection piece 11 into gas collecting chamber 3, further through grate 2 and the bed of heat carriers 6 into chamber 5, through inner grate 4 into hot gas chamber 7. On their way the gases have been heated on hot heat carriers 6 and leave the regenerator through connection piece 12.

Openings 13 and 14 adapted to be closed by flanges can also be seen on the regenerator vessel. Through connection pieces 14 heat carriers 6 can be removed from chamber 5 and at the same time refilled through openings 13, during operation or servicing and repair periods. It is thus possible to replace the entire fill of heat carriers 6 in chamber 5 discontinuously or continuously.

It is within the scope of the invention to adapt the method and the regenerator to the different conditions of industrial application. As explained above, the materials for the grates and heat carriers can be coordinated with the temperature requirements. The shape of the regenerator can also be modified in accordance with its use, but the principle of radial flow through the heat carrier bed should be retained.

What is claimed:

1. A regenerator for heating gases by alternatingly first heating up heat carriers by hot gas and thereafter using the heat energy stored by the heat carriers to heat cold gases, said regenerator having an axis of symmetry and including an outer wall, an inner grate and at least one outer grate spaced therefrom and coaxial therewith, a hot gas collecting chamber located inside the inner grate, a second gas collecting chamber located between an outer grate and the regenerator outer wall, carriers located between the inner grate and the at least one outer grate, said heat carriers including a first annular bed of a first heat resistance material adjacent said inner grate, a second annular bed of a second heat resistant material between said first heat resistance material and said outer grate, said first heat resistance material having a resistance to heat greater than said second heat resistant material.

2. Regenerator of claim 1, wherein the inner grate and the outer grate are made of different materials.

3. Regenerator of claim 1 or 2, wherein at least three coaxial grates are located within the regenerator.

4. Regenerator of claim 1 or 2, further including means for at least partly replacing the heat carriers at any time the regenerator is in operation.

5. Regenerator of claim 1 or 2, wherein the heat carriers are briquetted, sintered ceramic materials of oval shape.

6. Regenerator of claim 1 or 2, wherein the heat carriers are briquetted, sintered ceramic materials of spherical shape.

7. Regenerator of claim 3, wherein at least two annular spaces are defined between the at least three coaxial grates, and wherein the space defined on one side thereof by the innermost grate contains corundum as the heat carrier, the space defined on one side by the outermost grate contains, as the heat carrier, a material selected from the group consisting of mullite, chamotte and mixtures thereof, and the spaces therebetween contain, as the heat carrier, a material selected from the group consisting of corundum, mullite, chamotte and mixtures thereof.

8. Regenerator of claim 1 or 2, wherein the hot gas collecting chamber is of generally cylindrical shape.

9. Regenerator of claim 1 or 2, wherein the second gas collecting chamber is of generally annular shape.

10. In a process of regenerative gas heating by alternatingly:

(1) passing hot gas to be cooled from an hot gas entry and collection zone radially outwardly thereof (a) through a heat transfer zone comprising at least one bed of substantially uniform annular cross-section containing particulate heat carriers wherein heat energy is removed from the gas and stored in the heat carriers, and (b) into a cold gas entry and collection zone, and (2) then passing cold gas to be heated from the cold gas entry and collection zone radially inwardly thereof (a) through the heat transfer zone and (b) into the hot gas entry and collection zone, the improvement wherein step (1) the hot gas first is passed into and partially cooled in a first portion of the heat transfer zone wherein the heat carriers are of a material having a heat resistance greater than that of the heat carriers in a second portion of the zone, and in step (2) the cold gas first is passed into and partially heated in the second portion of the heat transfer zone, then passed through the first portion of the heat transfer zone.

11. A method according to claim 10, wherein the heat transfer material in the first portion of the heat transfer zone is corundum.

12. A method according to one of claims 10 and 11 wherein the heat transfer zone comprises at least three coaxially disposed annular beds and wherein at least a major part of the heat carriers in the bed adjacent the hot gas entry and collection zone consists of corundum and at least a major part of the heat carriers in at least the bed adjacent the cold gas entry and collection zone are of a material selected from the group consisting of mullite, chamotte and mixtures thereof.

13. The regenerator of claim 1 wherein the heat carriers are selected from the group consisting of corundum, mullite, chamotte and mixtures thereof.

* * * * *